US007972529B2

(12) United States Patent
Machado

(10) Patent No.: US 7,972,529 B2
(45) **Date of Patent: *Jul. 5, 2011**

(54) LUBRICANT OIL FOR A REFRIGERATION MACHINE, LUBRICANT COMPOSITION AND REFRIGERATION MACHINE AND SYSTEM

(75) Inventor: Rosangela Maria Machado, Joinville (BR)

(73) Assignee: Whirlpool S.A., Sao Paulo -Sp (BR)

( * ) Notice: Subject to any disclaimer, the term of this patent is extended or adjusted under 35 U.S.C. 154(b) by 0 days.

This patent is subject to a terminal disclaimer.

(21) Appl. No.: 12/795,955

(22) Filed: Jun. 8, 2010

(65) Prior Publication Data

US 2010/0249002 A1 Sep. 30, 2010

Related U.S. Application Data

(63) Continuation of application No. 11/993,161, filed as application No. PCT/BR2006/000136 on Jun. 30, 2006, now Pat. No. 7,758,768.

(30) Foreign Application Priority Data

Jun. 30, 2005 (BR) ..... 0502759

(51) Int. Cl.
*C09K 5/04* (2006.01)
*C10M 169/04* (2006.01)
*F25B 1/00* (2006.01)

(52) U.S. Cl. ..... 252/68; 252/67; 508/110; 62/502

(58) Field of Classification Search ..... 252/68, 252/67; 508/110; 62/502
See application file for complete search history.

(56) References Cited

U.S. PATENT DOCUMENTS

| | | | | |
|---|---|---|---|---|
| 5,577,391 | A | 11/1996 | Mangyo et al. | |
| 5,681,501 | A | 10/1997 | Minor | |
| 6,207,071 | B1 | 3/2001 | Takigawa et al. | |
| 6,526,764 | B1 | 3/2003 | Singh et al. | |
| 7,560,044 | B2 | 7/2009 | Leck et al. | |
| 7,696,137 | B2 * | 4/2010 | Yagishita | 508/371 |
| 2009/0072188 | A1 * | 3/2009 | Machado | 252/68 |

FOREIGN PATENT DOCUMENTS

| | | | |
|---|---|---|---|
| EP | 1018538 | A1 | 7/2000 |
| JP | 05140545 | A | 6/1993 |
| WO | WO-03044137 | A2 | 5/2003 |

OTHER PUBLICATIONS

EMBRACO, Technical Information Sheet, "Isobutane (R 600a) as a Refrigerant", 3 pages (2006).
EMRACO, Technical Information Bulletine, Compressor Catalog, 3 pages (2010).
ICOR, Material Safety Data Sheet, "One Shot (R-422A)", Chemical Production/Company Identification, 2 pages (2005).
English Translation of Motta et al., Refrigerant-Lubricating Oil Mixtures: Saturation Pressure and Temperature, Ciencia & Engenharia, 7(2) (1998), 70-78.
Devotta et al., "Performance of two door refrigerators retrofitted with a HC blend", Emerging Trends in Refrigeration & Air Conditioning, MR Conference, New Delhi, India, Mar. 18-20, 1998, 210-220.
Motta et al., "Refrigerant-lubricating oil mixtures: Saturation pressure and temperatures", Ciencia & Engenharia (1998), 7(2), 70-78.
Parra et al., "Stability of two polyol ester lubricant oils in hermetic compressors", Anais da Associacao Brasileira de Quimica, 45(3) (1996), 111-116.
Reg. No. 74-98-6, Nov. 16, 1984.
Reg. No. 382-09-2, Nov. 16, 1984.
Reg. No. 75-28-5, Nov. 16, 1984.

* cited by examiner

*Primary Examiner* — Douglas McGinty
(74) *Attorney, Agent, or Firm* — Gifford, Krass, Sprinkle, Anderson & Citkowski, P.C.

(57) ABSTRACT

A lubricant oil for a refrigeration machine, and refrigeration machine, said refrigeration machine being of the type that operates with a refrigerant consisting of at least one component of the HC (hydrocarbon) group, the lubricant oil consisting of an alkylbenzene oil containing at least 80% by weight of alkylbenzene having a molecular weight of 120-288 and having a viscosity between about 3.0 and 7.0 cSt at a temperature of 40° C. and the lubricant composition consisting of said alkylbenzene oil and until about 8% by weight of one or more additives selected from a group consisting of improvers of oxidation resistance and thermal stability, corrosion inhibitors, metal inactivators, lubricity additives, viscosity index improvers, reducers of fluidity and flocculation point, detergents, dispersants, antifoaming agents, antiwear agents and extreme pressure resistant additives.

12 Claims, No Drawings

LUBRICANT OIL FOR A REFRIGERATION MACHINE, LUBRICANT COMPOSITION AND REFRIGERATION MACHINE AND SYSTEM

CROSS-REFERENCE TO RELATED APPLICATIONS

This Application is a Continuation of application Ser. No. 11/993,161 filed on Jan. 21, 2008, now U.S. Pat. No. 7,758,768, which is the National Phase Application of PCT/BR2006/000136, which claims priority of Application PI0502759-4filed on Jun. 30, 2005 in Brazil, which are herein incorporated by reference.

FIELD OF THE INVENTION

The present invention refers to an alkylbenzene lubricant oil to be employed in a refrigeration machine, such as a hermetic compressor of the type used in refrigeration systems, such as small refrigeration systems, of domestic, commercial or industrial use, which operate with a refrigerant of the HC (hydrocarbon) group. The present invention also refers to a refrigeration machine containing said lubricant oil.

BACKGROUND OF THE INVENTION

The traditional refrigerants applied to domestic refrigeration until the mid-nineties were compounds based on chlorofluorocarbon (CFCs). However, since these compounds have proved to cause damages to the ozone layer in the high atmosphere, the use of such compounds is now limited and regulated under the terms of the Montreal Protocol. The CFCs used in domestic applications were initially substituted by hydrofluorocarbons (HFCs) which have zero potential of aggression to the ozone layer (ODP). Nevertheless, the application of HFCs compounds has a significant global warming potential (GWP), and for this reason said HFCs compounds have been substituted by hydrocarbons (HC)-based refrigerants, mainly in European and Asian domestic markets.

The change of refrigerants in refrigeration systems also leads to a change in the lubricant oils used in these refrigeration system, due to the necessity of making said components mutually compatible in the compressor of said refrigeration systems, in order to avoid, for example, reactions that produce acids in these systems and other components that are prejudicial to the integrity and efficiency of said system.

For systems using HFC refrigerants there are known some prior art solutions that utilize the alkylbenzene lubricant oil, as described in U.S. Pat. No. 6,207,071 (in which said oil is used with or without phosphoric esters-based additives in specific ratio and molecular weight). Said solution disclosed in U.S. Pat. No. 6,207,071 requires, to be utilized with the refrigerants consisting of HFC-134a and/or HFC-125, a lubricant oil comprising an alkylbenzene oil containing 60% by weight of alkylbenzene oil with molecular weight of 200-350 and, in case of using additives, 0.01-5.0% by weight (based on the total amount of the present oil composition) of a phosphoric ester compound.

Although this lubricant oil solution presents advantages in its use as a lubricant in refrigeration systems containing HFC, such composition is not applicable in temperature conditions inferior to about 20° C., since the present lubricant oil presents, in these or in lower temperatures, a low miscibility with the refrigerants consisting of HFC-134a and/or HFC-125. At temperatures around 0° C. or lower, this known prior art lubricant oil cannot be applied with refrigerants consisting of HFC-134a and/or HFC-125.

OBJECTIVES OF THE INVENTION

Thus, it is an object of the present invention to provide an alkylbenzene lubricant oil to be used in refrigeration machines, such as compressors, which operate with a refrigerant consisting of at least one component of an HC (hydrocarbon) group, for example, a refrigerant consisting of HC-600a and/or HC-290, said lubricant oil maintaining its conditions of lubricity and miscibility unaltered even in low temperatures, such as the usual operational temperatures of refrigeration systems which are generally lower than 10° C., avoiding collapse of the compressor, and maintaining high reliability for a long period of time, at minimum during the useful life of the compressor.

It is a further object of the present invention to provide a refrigeration machine using an HC-based refrigerant, as mentioned above and containing said lubricant oil or said lubricant composition.

SUMMARY OF THE INVENTION

These and other objects are attained through a lubricant oil for a refrigeration machine which operates with a refrigerant consisting of at least one component of the HC (hydrocarbon) group, said lubricant oil comprising an alkylbenzene oil containing at least 80% by weight of alkylbenzene having a molecular weight of 120-288 and having a viscosity between about 3.0 and 7.0 cSt at a temperature of 40° C.

The present invention further provides a refrigeration machine containing said lubricant oil defined above.

DETAILED DESCRIPTION OF THE PREFERRED EMBODIMENTS

The lubricant oil of the present invention will be described for application with heat exchange organic refrigerants that include at least one component of a hydrocarbon (HC) group, such as, for example, at least one of the refrigerants containing HC-600a and/or HC-290, for use in refrigeration machines of the type used in refrigeration systems, particularly of domestic use, said machines being defined, for example, by hermetic compressors.

For these groups of refrigerants, it is used a lubricant oil that presents a viscosity in the range of about 3.0 to about 7.0 cSt at a temperature of 40° C. In a first aspect of this invention, there is established a lubricant oil for refrigeration to be used with an HC refrigerant containing, for example, HC-600a and/or HC-290, which consists of an alkylbenzene oil containing 85% by weight or more of alkylbenzene, having a molecular weight of 120-288 or, more particularly, an alkylbenzene oil containing 85% by weight or more of straight alkylbenzene having a molecular weight of 120-288.

Moreover, since it improves the property that impedes the collapse of the hermetic compressor during the long period of operation, the alkylbenzene is preferably selected from those alkylbenzene oils containing 80% by weight or more, more preferably 85% by weight or more, more preferably 90% by weight or more of straight alkylbenzene having a molecular weight of 120-288.

The alkylbenzene lubricant oil of the present invention does not present restriction in relation to the molecular structure of the alkylbenzene component, its molecular weight being preferably defined within the range of 120-288. Nevertheless, considering the interest to improve the long-term reliability of a refrigeration system, it is preferable to select an alkylbenzene containing 1-4 alkyl groups, each group containing 1-15 carbon atoms and the total amount of carbon atoms in the alkyl groups being 3-15, and more preferably to select an alkylbenzene containing 1-4 alkyl groups, each group containing 1-13 carbon atoms and the total amount of carbon atoms in the alkyl groups being 3-13.

Examples of alkyl group containing 1-15 carbon atoms are methyl, ethyl, propyl (including all isomers), butyl (including all isomers), pentyl (including all isomers), hexyl (including all isomers), heptyl (including all isomers), octyl (including all isomers), nonyl (including all isomers), decyl (including all isomers), undecyl (including all isomers), dodecyl (including all isomers), tridecyl (including all isomers), tetradecyl (including all isomers), pentadecyl (including all isomers).

These alkyl groups may be of a straight-chain or branched-chain. However, in view of the stability and viscosity of the alkylbenzenes, the branched-chain monoalkyl groups are preferable, since the chain straightness leads to a better lubricity and the existence of an alkyl group has a positive influence in the chemical stability of the alkylbenzene oil.

The number of alkyl groups in the benzene mentioned above is defined from 1 to 4. Nevertheless, in view of the stability and availability of the alkylbenzene, it is most preferable to select an alkylbenzene containing one or two alkyl groups, i.e., a monoalkylbenzene, a dialkylbenzene or a mixture thereof, more preferably, a monoalkylbenzene, in straight-chain or branched-chain.

It is also possible to employ not only the alkylbenzenes defined above having the same molecular structure, but also those having different molecular structures, as long as there are satisfied the conditions that they contain 1-4 alkyl groups, each group containing 1-15, preferably 1-13 carbon atoms and the total amount of carbon atoms in the alkyl groups being 3-15, preferably 3-13.

Aromatic compounds which may be used as raw material include benzene, toluene, xylene, ethylbenzene, methylethylbenzene, diethylbenzene and a mixture, whose alkylating agents that may be used herein include a lower olefin such as ethylene, propylene, butene, or isobutylene; preferably an olefin of a straight-chain or branched-chain having 6-15 carbon atoms, that can be derived from the polymerization of propylene; an olefin of a straight-chain or branched-chain having 6-15 carbon atoms, that can be derived from the thermal decomposition of wax, heavy oils, a petroleum fraction, polyethylene or polypropylene; an olefin of straight-chain having 6-15 carbon atoms that can be obtained by separating n-paraffins from a petroleum fraction, such as kerosene or gas oil and then by catalytically transforming the rest of the paraffin into an olefin; and the mixture of these olefins.

An alkylating catalyst for use in alkylation includes a conventional catalyst exemplified by Friedel-Crafts catalysts, such as aluminum chloride or zinc chloride; or an acidic catalyst defined by sulfuric acid, phosphoric acid, hydrofluoric acid or activated clay.

The alkylbenzene oil of this invention may be obtained by separately mixing alkylbenzene preparations having a molecular weight ranging from 120 to 288, with the alkylbenzene having a molecular weight of less than 120 and more than 288 in a range as defined by this invention. However, it is advisable, in practice, to obtain a distillate containing at least 85% by weight of alkylbenzene, being predominantly a straight alkylbenzene having a molecular weight ranging from 120 to 288, through distillation or chromatography from a mixture of alkylbenzenes manufactured according to the method explained above or is available in the market.

The lubricant oil object of the present invention comprises the alkylbenzene oil as defined above, which can be suitably used as a lubricant oil for an HC refrigerant containing HC-600a and/or HC-290, without accompaniment of an additive. However, it is also possible to use in the form of a composition containing the lubricant oil and one or more additives.

Since the additivated naphthenic mineral lubricant oil and with viscosity around 5 cSt at a temperature of 40° C. presents a low melting point (120° C.), the present invention further provides an additivated straight alkylbenzene lubricant for use in hermetic compressors of high efficiency, which presents a melting point around 145° C. for viscosity around 5 cSt at a temperature of 40° C.

An example of suitable alkylbenzene oil is that containing straight alkyl group with lateral paraffinic chain of 10-13 carbon atoms, with average molecular weight of 239-244 g/Mol, and has a viscosity of 4-5 cSt at a temperature of 40° C., containing antiwear additive based on phosphate esters (2.0+/−0.3% p/p of triphenyl phosphate butylated), as described below.

According to a first aspect of the present invention, there is provided a lubricant oil comprising an alkylbenzene oil containing at least 85% by weight of alkylbenzenes presenting a molecular weight of 120-288 and having a kinematic viscosity of 3-7 cSt until a temperature of 40° C., said alkylbenzene oil being selected from groups consisting of at least monoalkylbenzene, dialkylbenzene and a mixture of monoalkylbenzene and dialkylbenzene, preferably a monoalkylbenzene. In a more specific way, the present invention provides an alkylbenzene lubricant oil containing 1-4 alkyl groups, each alkyl group containing 1-15 carbon atoms and a total amount of carbon atoms in said alkyl groups being 3-15 and, more particularly, each alkyl group containing 1-13 carbon atoms and a total amount of carbon atoms in the alkyl groups being 3-13.

More specifically, the alkylbenzene lubricant oil with molecular weight of 120-288 of the present invention contains alkyl groups of straight-chain or branched-chain, preferably of straight-chain, said alkylbenzene lubricant oil containing at least 85% by weight of straight alkylbenzene with a molecular weight of 162-288.

Under some use conditions, the alkylbenzenes with a kinematic viscosity of 3-7 cSt until a temperature of 40° C. as described herein, work satisfyingly as complete lubricants. In order to have a complete lubricant oil, however, it is generally preferable that it contains other materials, usually denominated as additives, such as: improvers of oxidation resistance and thermal stability, corrosion inhibitors, metal inactivators, additives of lubricity, viscosity index improvers, reducers of fluidity and flocculation point, detergents, dispersants, antifoaming agents, antiwear agents and extreme pressure resistant additives. Many additives are multifunctional. For example, certain additives can present both extreme resistance to pressure and antiwear properties, or both functions as a metal inactivator and a corrosion inhibitor. Cumulatively, all the additives in a composition should not exceed, preferably, 8% by weight or, more preferably, 5% by weight of the total formulation of the lubricant composition.

An effective amount of types of adequate additives is generally in the range of 0.01-5% for an antioxidant component, 0.01-5% for a corrosion inhibitor component, 0.001-0.5% for a metal inactivator component, 0.5-5% for the lubricity additives, 0.01-2% for each viscosity index improver and reducer of fluidity and/or flocculation point, 0.1-5% for each detergent and dispersant, 0.001-1% of antifoaming agents, and 0.1-3% for each component resistant to extreme pressure and antiwear component. All these percentages are by weight and based on the total lubricant composition. However, it should be understood that larger or smaller quantities of additives can be used, as a function of the particular circumstances of the composition and its application, and that a type of simple molecule or a type of mixture can be used for each type of additive. Moreover, the examples mentioned herein should be understood as exemplary, rather than limitative.

Examples of certain improvers of oxidation resistance and thermal stability are the diphenyl-dinaphthyl-, and phenyl-naphthyl-amines, in which the phenyl and naphthyl groups can be substituted, i.e., N,N'-diphenyl phenylenediamine, p-octyldiphenylamine, p,p-dioctyldiphenylamine, N-phenyl-1-naphthyl amine, N-phenyl-2-naphthyl amine, N-(p-dodecyl)phenyl-2-naphthyl amine, di-1-naphthylamine, and di-2-naphthylamine; phenothiazines such as N-alkylphenothiazines; imino(bisbenzyl); and phenols such as 6-(t-butyl)phenol, 2,6-di-(t-butyl)phenol, 4-methyl-2,6-di-di-(t-butyl)phenol, 4,4'-methylenebis(-2,6-di-(t-butyl) phenol).

Examples of certain cuprous metal inactivators are imidazole, benzomidazole, 2-mercaptobenzotriazole, 2,5-di-mercaptotriazole, salicylidene-propylenediamine, pyrazole, benzotriazole, tolutriazole, 2-methylbenzamidezol, 3,5-dimethyl pyrazole, and methylene bisbenzotriazole. Benzotriazole derivatives are preferred. Other common examples of metal inactivators and/or corrosion inhibitors include organic acids and their esters, metallic salts, and anhydrides, i.e., N-oleyl-sarcosine, sorbitan monooleate, lead naphtenate, dodecenyl-succinic acid and its esters and partial amides, and 4-nonylphenoxyacetic acid; primary, secondary and tertiary aliphatic and cycloaliphatic amines and amine salts of organic and inorganic acids, i.e., oil-soluble alkylammonium carboxylates; heterocyclic compounds containing nitrogen, i.e., thiodiatriazoles, substituted imidazolines, and oxazolines; barium dinonyl naphthalene sulphonate; quinolines, quinones, and anthraquinones; propyl gallate; ester and derivatives of amide of alkenyl succinic anhydrides or acids, dithiocarbamates, dithiophosphates; amine salts of alkyl acid phosphate and derivatives thereof.

Examples of certain lubricity additives include derivatives of fatty acids of long chain and natural oils, such as esters, amines, imidazolines and borates.

Examples of certain viscosity index improvers include polymetacrylates, copolymers of vinyl pyrrolidone and metacrylates, polybutenes and copolymers of styrene-acrylate.

Examples of certain reducers of fluidity and/or flocculation point include polymetacrylates such as metacrylate-ethylene-vynil acetate thermopolymers; alkylated naphthalene derivatives; and Friedel-Crafts products catalyzed by condensation of urea with naphthalenes or phenols.

Examples of certain detergents and/or dispersants include polybutenylsuccinic acid amides; polybutenyl phosphonic acid derivatives; alkyl sulphonic aromatic acids of long chain and their salts; and metallic salts of alkyl sulfites, of alkylphenols, and of condensation products of alkylphenol and aldehydes.

Examples of certain antifoaming agents include polymers of silicone and some acrylates.

Examples of certain agents resistant to extreme pressure and antiwear agents include sulphurized fatty acids and esters of fatty acids, such as sulphurized octyl thallate; sulphurized terpenes; sulphurized olefins; organopolysulfides; organophosphorous derivatives including amine phosphates, alkyl acid phosphates, dialkyl phosphates, aminedithiophosphate, trialkyl and triaryl phosphorothionates, trialkyl and triaryl phosphines, and dialkylphosphites, i.e., amine salts of monohexyl phosphoric acid ester, amine salts of dinonylnaphthalene sulfonate, triphenyl phosphate, trinaphthyl phosphate, diphenyl cresyl and dicresyl phenyl phosphates, naphthyl diphenyl phosphate, triphenylphosphorothionate; dithiocarbamates, such as an antimony dialkyl dithiocarbamate; chlorinated and/or fluorinated hydrocarbons and xanthalates.

Thus, according to a second aspect of the present invention, there is provided a fluid lubricant composition comprising a base alkylbenzene oil or a straight alkylbenzene oil having a molecular weight of 120-288 and comprising until about 8% by weight of one or more additives selected from a group consisting of improvers of oxidation resistance and thermal stability, corrosion inhibitors, metal inactivators, lubricity additives, viscosity index improvers, reducers of fluidity and flocculation point, detergents, dispersants, antifoaming agents, antiwear agents and extreme pressure resistant additives. In a particular form of the present invention, the additive comprises at least one type of phosphorous compound selected from the group consisting of phosphoric ester, phosphoric acid esters, amine salts of phosphoric acid esters, chlorinated phosphoric esters and phosphorous esters.

More specifically, in this second aspect of the present invention, there is provided a fluid lubricant composition in which the alkylbenzene oil contains at least 90%, for example, 100% by weight of straight alkylbenzene with a molecular weight of 218-260 and in 0.01-5.0% by weight and, more particularly 0.005-5.0% by weight (based on the total amount of the oil composition) of a phosphate ester compound.

In view of improving the refrigeration mechanism in relation to wear resistance and load resistance, it is preferable to blend a refrigerant oil with at least one type of phosphorous compound selected from the group consisting of phosphoric esters, phosphoric acid esters, amine salts of phosphoric acid esters, chlorinated phosphoric esters and phosphorous esters.

These phosphorous compounds are esters obtained from a reaction between phosphoric acid or phosphorous acid and an alcohol or an alcohol-type polyester, or such as phosphorous compounds.

Phosphoric esters used herein include tributyl phosphate, triphenyl phosphate, trihexyl phosphate, triheptyl phosphate, trioctyl phosphate, trinonyl phosphate, tridecyl phosphate, tritetradecyl phosphate, tripentadecyl phosphate, trihexadecyl phosphate, triheptadecyl phosphate, trioctadecyl phosphate, trioleyl phosphate, tricresyl phosphate, trixylyl phosphate, cresyldiphenyl phosphate and xylydiphenyl phosphate.

Acid phosphoric esters used herein include monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, diphenyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dioctadecyl acid phosphate and dioleyl acid phosphate. Examples of amine salts of phosphoric acid ester are methyl amine, ethyl amine, propyl amine, butyl amine, pentyl amine, hexyl amine, heptyl amine, octyl amine, dimethyl amine, diethyl amine, dipropyl amine, dibutyl amine, dipentyl amine, dihexyl amine, diheptyl amine, dioctyl amine, trimethyl amine, triethyl amine, tripropyl amine, tributyl amine, tripentyl amine, trihexyl amine, triheptyl amine, and trioctyl amine of phosphoric acid ester. Examples of chlorinated phosphoric ester are tris-dichloropropyl phosphate, tris-chloroethyl phosphate, tris-chloropentyl phosphate, and polyoxyalkylene bis[(dichloroalkyl)] phosphate.

Examples of phosphorous ester are dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite and tricresyl phosphite. It is also possible to use a mixture of these compounds.

These phosphorous compounds may be blended with the lubricant oil in any desired mixing ratio. Nevertheless, it is generally preferable to blend these phosphorous compounds in the ratio of 0.005-5.0% by weight, more preferably 0.01-3.0% by weight based on the total amount of the lubricant oil composition for refrigeration (a total of the alkylbenzene oil of this invention and all the additives).

If the amount of the phosphorous compound added is less than 0.005% by weight, based on the total amount of the lubricant oil composition for refrigeration, any substantial effect on the improvement of wear resistance and load resistance would not be attained by the addition of this compound. On the other hand, if the amount of the phosphorous compound added exceeds 5.0% by weight, based on the total amount of the lubricant oil composition for refrigeration, it may give rise to corrosion in the refrigeration system during its use for a long period of time.

An example of straight alkylbenzene lubricant oil of the present invention is defined as follow:

Straight Alkylbenzene (LAB) with lateral paraffinic chain of 10-13 carbon atoms, with an average number of 11.7 carbon atoms.

(Benzene), C10-13—alkyl derivative

Formula: $CH_3—(CH_2)_n—CH\ (C_6H_5)\text{-}(CH_2)_m—CH_3$
(n+m=7-10) (n,m+0-10)

Average molecular weight: 239-244 g/Mol

Paraffins, % mass: 0.4 max.

Branched alkylbenzene+DAT+Diphenylalkanes, % mass: 8.0 max.

Dialkyltetralin/Indanes (DAT): % mass: 1.0 max.

2-Phenyl Isomers, % mass: 20 max.

Straight Alkylbenzene, % mass: 92 min

Mono Alkylbenzene, % mass: 98.6 min

Distribution of Carbons, % mass:

Phenyl<C10: 1.0 max.

Phenyl C10: 5-16

Phenyl C11: 28-45

Phenyl C12: 25-40

Phenyl C13: 10-30

Phenyl >/=C14: 1.0 max.

An example of additive of the present invention is defined as follows:

Chemical name: triphenyl butylated phosphate

Chemical formula: mixture

| Substances |
|---|
| t-butylphenyl diphenyl phosphate |
| Bis (t-butylphenyl) phenyl phosphate |
| Tri (t-butylphenyl) phosphate |
| Triphenyl phosphate |

The lubricant oil (and also the composition using said lubricant oil and the additive of the present invention) results, in tests, in better characteristics of higher melting point, better lubricity, higher thermal stability, and an increased viscosity index (VI), as compared with conventional lubricant oils. As to the alkylbenzene oil used with refrigerant of the HFC type, the lubricant oil of the present invention presents increased miscibility in temperatures lower than 0° C., including those generally used in the operations of refrigeration systems, which are generally lower than −10° C.

Besides, the lubricant oil as well as the composition containing said lubricant oil and also an additive (for example, 2.0+/−0.3% p/p of triphenyl butylated phosphate) of the present invention present the advantages of: good chemical compatibility with the fluid refrigerant containing HC-600a and the compressor components; excellent tribological results for use in compressors of high efficiency; has the highest viscosity index (VI) as compared with the R134a and R600a oils; low cost; and low environmental impact, as a function of the benzene biodegradability, C10-13 that composes said alkylbenzene lubricant oil.

The invention claimed is:

1. A lubricant oil for a refrigeration machine which operates with a refrigerant consisting of at least one HC (hydrocarbon) group component, characterized in that it comprises an alkylbenzene oil containing at least 90% by weight of straight-chain alkylbenzene selected from a straight-chain alkyl group with lateral paraffinic chain of 10-13 carbon atoms with an average molecular weight of 239-244 g/Mol, and having a viscosity between about 4.0 and 5.0 cSt at a temperature of 40° C.

2. The lubricant oil, as set forth in claim 1, characterized in that the alkylbenzene contains 1-4 alkyl groups, each group containing 10-13 carbon atoms.

3. The lubricant oil, as set forth in claim 1, characterized in that the alkylbenzene is selected from the group consisting of monoalkylbenzene, dialkylbenzene or a mixture thereof.

4. Refrigeration machine for operating with a refrigerant consisting of at least one component of the HC (hydrocarbon) group, characterized in that the refrigeration machine comprises a lubricant oil constituted by an alkylbenzene oil containing at least 90% by weight of straight-chain alkylbenzene selected from a straight-chain alkyl group with lateral paraffinic chain of 10-13 carbon atoms with an average molecular weight of 239-244 g/Mol, and having a viscosity between about 4.0 and 5.0 cSt at a temperature of 40° C.

5. Refrigeration machine for operating with a refrigerant consisting of at least one component of the HC (hydrocarbon) group, characterized in that the refrigeration machine comprises a lubricant composition constituted by:

an alkylbenzene oil containing at least 90% by weight of straight-chain alkylbenzene, selected from a straight-chain alkyl group with lateral paraffinic chain of 10-13 carbon atoms with an average molecular weight of 239-244 g/Mol, and having a viscosity between about 4.0 and 5.0 cSt at a temperature of 40° C.; and from 0.01-5.0 by weight of one or more additives selected from a group consisting of at least one type of phosphorous compound selected from phosphoric ester and phosphorous esters.

6. Refrigeration machine, as set forth in claim 5, characterized in that the alkylbenzene is selected from the group consisting of monoalkylbenzene, dialkylbenzene or a mixture thereof.

7. Lubricant composition for use in a refrigeration machine which operates with a refrigerant consisting of at least one component of an HC (hydrocarbon) group, characterized in that it comprises: an alkylbenzene oil containing at least 90% by weight of straight-chain alkylbenzene selected from a straight-chain alkyl group with lateral paraffinic chain of 10-13 carbon atoms with an average molecular weight of 239-244 g/Mol, and having a viscosity between about 4.0 and 5.0 cSt at a temperature of 40° C.; and from 0.01-5.0% by weight of one or more additives selected from the group consisting of at least one type of phosphorous compound selected from phosphoric ester and phosphorous esters.

8. Lubricant composition, as set forth in claim 7, characterized in that the alkylbenzene is selected from the group consisting of monoalkylbenzene, dialkylbenzene or a mixture thereof.

9. Lubricant composition, as set forth in claim 7, characterized in that the additive is provided in the range of 0.01-3.0% by weight based on the total amount of the lubricant oil composition for refrigeration.

10. Refrigeration machine, as set forth in claim 4, characterized in that the alkylbenzene contains 1-4 alkyl groups, each group containing 10-13 carbon atoms.

11. Refrigeration machine, as set forth in claim 10, characterized in that the alkylbenzene is selected from the group consisting of monoalkylbenzene, dialkylbenzene or a mixture thereof.

12. Refrigeration machine, as set forth in claim 5, characterized in that the alkylbenzene contains 1-4 alkyl groups, each group containing 10-13 carbon atoms.

* * * * *

UNITED STATES PATENT AND TRADEMARK OFFICE

CERTIFICATE OF CORRECTION

PATENT NO. : 7,972,529 B2
APPLICATION NO. : 12/795955
DATED : July 5, 2011
INVENTOR(S) : Rosangela Maria Machado It is certified that error appears in the above-identified patent and that said Letters Patent is hereby corrected as shown below:

In the Specification

Column 7, line number 57, Insert --Chemical family: aryl phosphate--.

Signed and Sealed this
Sixth Day of May, 2014

Michelle K. Lee

Michelle K. Lee
*Deputy Director of the United States Patent and Trademark Office*